United States Patent [19]

Hayashi

[11] Patent Number: 4,749,999

[45] Date of Patent: Jun. 7, 1988

[54] TRANSMITTING-RECEIVING ANTENNAS FOR VEHICLES

[75] Inventor: Hiroshi Hayashi, Chiba, Japan

[73] Assignee: Harada Kogyo Kabushiki Kaisha, Tokyo, Japan

[21] Appl. No.: 902,212

[22] Filed: Aug. 29, 1986

[30] Foreign Application Priority Data

Aug. 30, 1985 [JP] Japan ..... 60-191578

[51] Int. Cl.[4] ..... H01Q 1/32

[52] U.S. Cl. ..... 343/713; 343/712; 343/715

[58] Field of Search ..... 343/712, 713, 715, 829, 343/846

[56] References Cited

U.S. PATENT DOCUMENTS

| | | | |
|---|---|---|---|
| 3,071,338 | 1/1963 | Kaufman et al. | 343/713 |
| 3,899,148 | 8/1975 | Fleming | 343/715 |
| 4,035,806 | 7/1977 | Powell | 343/715 |
| 4,084,163 | 4/1978 | Maynard | 343/715 |
| 4,110,757 | 8/1978 | Sieber | 343/713 |
| 4,151,533 | 4/1979 | Vogt | 343/715 |
| 4,161,735 | 7/1979 | Zylla | 343/713 |
| 4,198,636 | 4/1980 | Canterbury et al. | 343/715 |

*Primary Examiner*—William L. Sikes
*Assistant Examiner*—Hoanganh Le
*Attorney, Agent, or Firm*—Koda and Androlia

[57] ABSTRACT

A transmitting-receiving antenna for a vehicle including a fixture for fixing an ultra high frequency grounded antenna thereon. One end of the fixture is connected to a grounding point of a feeding section of the antenna and the other end is connected to an antenna mounting point of a vehicle body. The fixture is further constructed such that the length or distance between the grounding point of the antenna feeding section and the mounting point of the vehicle is set at ½ wave length in electric length.

1 Claim, 3 Drawing Sheets

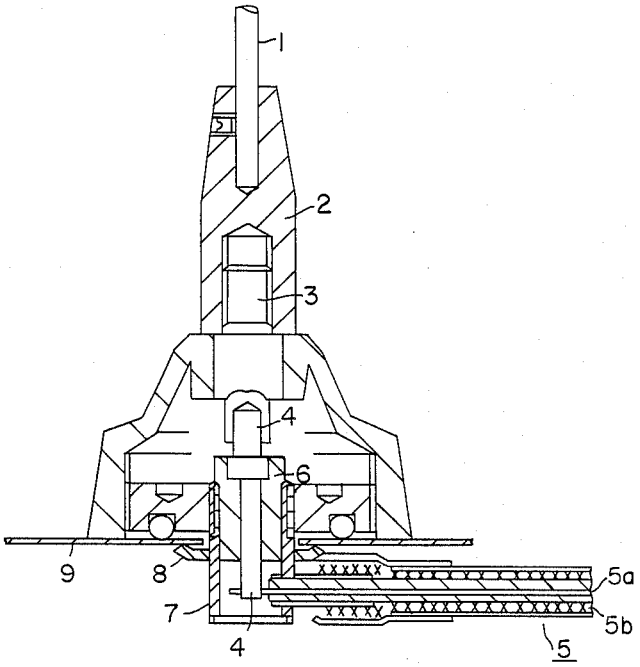
FIG. 5
PRIOR ART
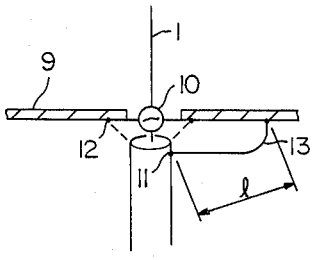
FIG. 6(a)
PRIOR ART
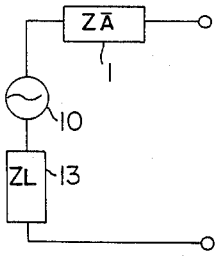
FIG. 6(b)
PRIOR ART
FIG. 6(c)
PRIOR ART
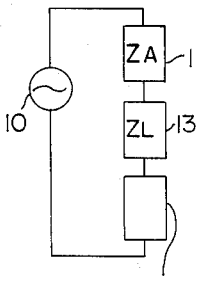
TRANSMISSION
RECEPTION
DEVICE

TRANSMITTING-RECEIVING ANTENNAS FOR VEHICLES

BACKGROUND OF THE INVENTION

1. Field of the Invention

The present invention relates to antennas for vehicles, and more particularly to a fixture for mounting an ultra high frequency grounded type antenna to a vehicle body.

2. Prior Art

Today, car telephones are used in many automobiles. There are two types of antennas used for car telephones. One type is a non-grounded antenna and the other is a grounded antenna.

Non-grounded antennas are usually not affected by external forces because of their impedance characteristics. Accordingly, they are widely used in car telephones. Since a non-grounded antenna does not need to be grounded, it is not necessary to drill a hole in the car body for mounting the antenna. Thus, the antenna is frequently mounted on the fender, trunk lid, bumper, etc. of the car. However, the non-grounded antenna has a complicated structure and is high in manufacturing cost.

On the other hand, the grounded antenna is relatively simple in structure and for this reason can be manufactured at low cost. Thus, it is desirable that the grounded antenna be used more frequently.

FIG. 5 shows an example of a conventional grounded antenna. In the Figure, the reference numeral 1 is an ultra high frequency antenna element. The antenna element 1 is connected to core 5a of a coaxial cable 5 through antenna base 2, a joint 3, and a contact pin 4. A conductive body 7 which coaxially surrounds the contact pin 4 through an insulator 6 is fixed and grounded on the vehicle body 9. Between the conductive body 7 and the vehicle body 9 is provided a grounding mount 8. The conductive body 7 is also connected to a shield cable 5b of the coaxial cable 5.

However this conventional antenna system has some problems since the grounded antenna requires a mounting hole on the vehicle body, the antenna mounting job is complicated. Also, such a hole could decrease the strength of the vehicle body. Thus, users are often reluctant to use a gounded antenna.

Furthermore, as shown by the dotted lines in FIG. 6(*a*), the grounded antenna must be grounded within the shortest possible distance between the grounding point 11 of a feeding section 10 and the grounding point 12 of the vehicle body 9. Practically, however, as shown by the solid line in FIG. 6(*a*), it is more likely that a lead section 13, which has the electric length l, is formed in the grounding circuit. When there is a lead section as shown in the Figure, the antenna output is split, by the impedance of the lead section, decreasing the gain and the antenna sensitivity.

In particular, if the impedance of the lead section 13 is ZL, and the impedance of the antenna is ZA, the equivalent circuit can be shown as FIG. 6(*b*) during the no-load period, and it can be shown as FIG. 6(*c*) during the load period such as when a transmission and reception device is connected to the antenna. As shown in FIGS. 6(*b*) and (*c*), ZL and ZA are always connected in series to the circuit. However, although the impedance ZL of the lead section 13 is zero when the electric length l equals zero, actually l does not become zero. Thus, the fact is that the impedance ZA of the antenna always has a certain value. As a result, the antenna output is split by the impedance ZL and the impedance ZA, resulting in loss of sensitivity loss.

SUMMARY OF THE INVENTION

Accordingly, it is a general object of this invention to provide an antenna system which can be mounted to a vehicle without opening any mounting hole.

It is another object of this invention to provide a high performance grounded antenna system which is inexpensive to manufacture and free from any sensitivity loss caused by the antenna mounting devices.

In keeping with the principles of the present invention, the objects are accomplished by a novel structure for an antenna system characterized by the fact that one end of an antenna fixture for mounting a grounded type ultra high frequency antenna to a vehicle body is connected to a grounding point of a feeding section of the antenna, and the other end of the antenna fixture is connected to an antenna mounting point on the vehicle body such that the length between the grounding point of the feeding section and the antenna mounting point of the vehicle is set at ½ wave length in electric length.

Since the antenna of this invention mounted to the vehicle body through the antenna fixture, an antenna mounting hole is not required. The antenna can be easily mounted, for instance, on the trunk lid in several different ways. Also, since the electric length of the antenna fixture is set as ½ wave length, the impedance of the lead section of the fixture can be zero, although it is actually not zero.

Meanwhile, when the electric length of the lead section of the antenna fixture is ¼ wave length, the impedance will become the maximum.

BRIEF DESCRIPTION OF THE DRAWINGS

The above mentioned features and objects of the present invention will become more apparent with reference to the following description taken in conjunction with the accompanying drawings showing the present invention applied as an embodiment to the antenna system for automobiles, wherein like reference numerals denote like elements and in which:

FIG. 1(*b*) is a sectional view showing the structure of an antenna of this invention mounted to a trunk of a vehicle;

FIG. 5 is a sectional view of a conventional antenna system;

FIGS. 6(*a*), 6(*b*) and 6(*c*) are schematic views showing problems in conventional antenna systems.

DETAILED DESCRIPTION OF THE INVENTION

Figure 1A:
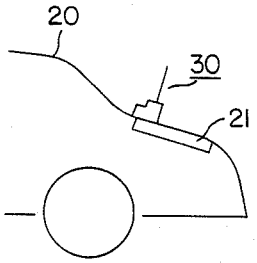
FIG. 1(*a*) is schematic view showing the antenna of the present invention mounted on a vehicle.
Figure 1B:
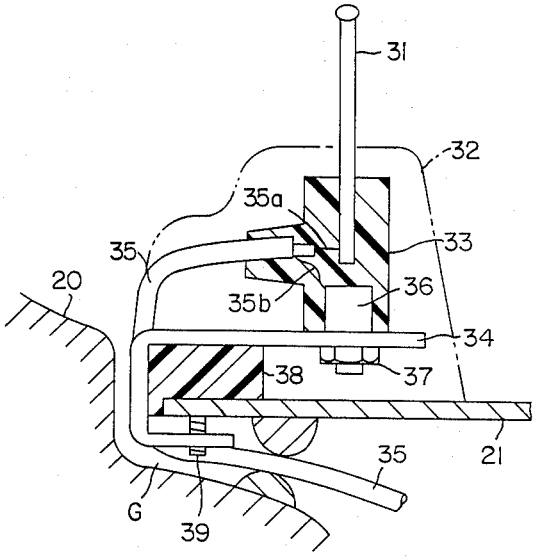

An antenna system 30 of this invention is mounted, for example, on the trunk lid 21 of an automobile 20 as shown in FIG. 1(*a*). The structure of the antenna system 30 is shown in detail in FIG. 1(*b*).

In this Figure, the reference numeral 31 is an ultra high frequency antenna element, and the base of the antenna element 31 is held by an insulated supporter 34. This supporter 33 is made of resins, plastics, ceramics, etc. and is housed in a mounting case 32. The insulated supporter 33 is placed fixed on an antenna fixture 34 which is attached at the edge of the trunk lid 21.

The end of a coaxial cable 35 is brought into the insulated supporter 33, and the base of the antenna element 31, which is also in the supporter 33, is connected to the core 35*a* of the coaxial cable 35. Shield wire 35*b* of the coaxial cable 32 is coupled to a grounding terminal 36 which is at the bottom of the insulated supporter 45. The grounding terminal 36 is electrically connected to the fixture 34 through a conductive stationary element 31. This stationary element 31 rigidly retains the insulated supporter 33 on the fixture 34.

The other end of the coaxial cable 35 is led inside the automobile 20 through a gap G which is between the trunk lid 21 and the vehicle body.

The fixture 34 is made of conductive materials and shaped substantially in a letter "J" in cross section. The insulated supporter 33 is retained at one end of this fixture 34. The other end of the fixture 34, which is the bent end of the fixture, is fixed at the edge of the trunk lid 21 with an insulated spacer 38 between the fixture 34 and the trunk lid 21. In particular, the fixture 34 is fixed on the trunk lid 21 by a screw 39 in a manner that the fixture 34 holds the edge of the trunk lid 21 at the bent end.

Figure 2:
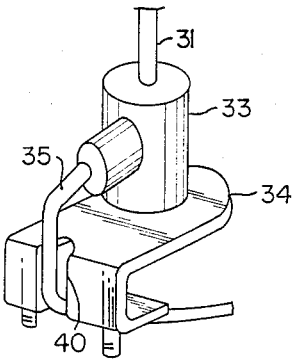
FIG. 2 is a perspective view of a main component of an antenna of the invention.

FIG. 2 is a perspective view of the fixture 34 and other major components. As seen from FIG. 2, a guide groove 40 for guiding the coaxial cable 35 is opened at the bent end of the fixture 34.

Figure 3:
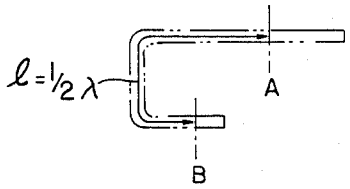
FIG. 3 is a schematic view showing electrical condition of an antenna fixture metal.

FIG. 3 illustrates the electrical conditions of the fixture 34. The position A of the fixture 34 is where a stationary element 37 is mounted. In other words, the position A is a grounding point for the feeding section of the antenna. The position B is where a screw for mounting the fixture to the automobile body is fastened. The electric length l between the portion A and the position B is set at ½ wave length of transmission-reception waves.

With the above distinctive features of the antenna system of the present invention in mind, attention will now turn to the function of this system.

Since the antenna can be mounted to the edge of the trunk lid 21 by screwing the fixture 34 to the trunk lid, it is not necessary to make a hole for mounting the antenna. Thus, the antenna mounting job is very simple, and the body of the automobile does not suffer any damages such as decrease in body strength, etc.

Also, since the electric length of the fixture 34 is set at approximately ½ wave length, the impedance of the lead section of the fixture 34 can be almost zero though it is actually not zero. As a result, the impedance of the fixture 34 does not affect the antenna output. Thus, the antenna output is not split, and the antenna can be free of any sensitivity loss.

Accordingly, the antenna is equivalent in function to the conventional direct grounded antenna and has excellent transmission and reception capabilities. Also, several experiments on the antenna system indicates that the difference in relative sensitivity between the antenna of the present invention and a typical dipole antenna is acceptable and satisfactory.

Further, since there is no need to use lead wires for grounding the antenna, it is very easy to connect the antenna to the equipment. Also, since the antenna itself is a grounded type, it is simple in structure and can be manufactured at a low price.

Furthermore, in the above embodiment, the insulated spacer 38 is placed between the fixture 34 and the trunk lid 21 in order to achieve good insulation. Therefore, even when the automobile is jolted severely, the fixture 34 does not hit or make any contact with the automobile body. Thus, a short circuit will not occur, and the electric length set at ½ wave length is not changed at all. Further, in case an elastic material is used for the insulated spacer 38, the surface of the trunk lid is prevented from being scratched. Also, since the elastic insulated spacer can work as a mounting washer, the antenna can be immovably mounted to the automobile body.

Figure 4:
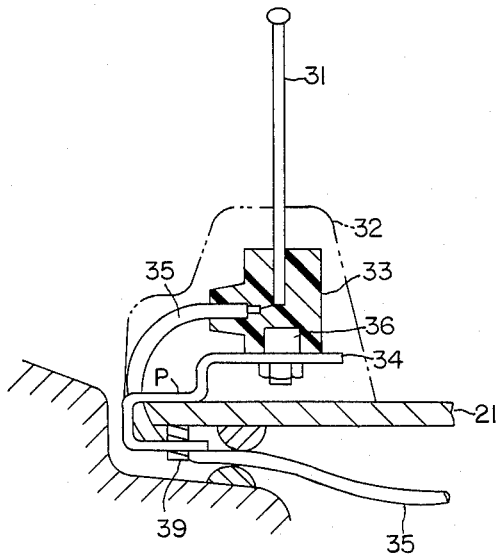
FIG. 4 is a sectional view of an antenna mounted to a trunk lid of a vehicle in a different way from the one shown in FIG. 1(*b*)

FIG. 4 shows the fixture 34 mounted on the automobile without using any spacer. In this case, violent vibrations could change the contact pressure P between the fixture 34 and the trunk lid 21. Usually, the surface of the trunk lid 21 is painted so that it is insulated. However, the surface is nearly conductive for high frequency waves such as ultra high frequency. Therefore, if the contact pressure P changes or becomes unstable, it is more likely that the electric length is also changed. If the length of the lead section changes a few centimeters, the ultra high frequency will change as much as ¼ wave length, causing the impedance to be almost infinity and resulting in fine transmission and reception become impossible. According to the inventors' experiments, if the antenna is mounted in the manner of FIG. 4, the relative sensitivity decreases as much as 8 dB compared to the antenna shown in FIG. 1(*b*).

The scope of the invention is not limited to the embodiment described above.

In the embodiment, the antenna system 30 is mounted on the edge of the trunk lid 21. It can be mounted on the fender, bumper, etc. Also, the present invention is described as an antenna for automobiles, it can be applicable for antennas for any kind of vehicle. It is apparent that the present invention is applicable in various ways within the scope of the spirit of the invention.

As mentioned in detail in the above, the present invention provides an antenna system which includes an antenna fixture for mounting an antenna to the automobile body. One end of the fixture is connected to the grounding point of the feeding section of the antenna and the other end of the fixture is connected to the antenna mounting point of the automobile, and the length or distance between the grounding point and the antenna mounting point is set at ½ wave length in electrical length. Accordingly, the antenna can be mounted on the vehicle body by the fixture, and it is not necessary to open a hole for mounting the antenna on the vehicle body. The antenna can be mounted on the trunk lid edge by securely placing or clasping the fixture thereon. Also, since the electric length of the fixture is set at ½ wave length, the impedance of the lead section of the fixture can be zero, though the actual length is not zero.

Thus, the present invention provides a grounded antenna for vehicles which can be mounted on the vehicle body without opening an antenna mountng hole, and the antenna can be free from sensitivity loss which could be caused by the lead section of the fixture. The antenna has excellent transmission and reception characteristics and can be manufactured at a low price.

What is claimed is:

1. An ultra high frequency transmitting-receiving antenna for vehicles comprising:

an antenna for ultra high frequency; and a fixture having said antenna mounted on one end of said fixture with a grounding point of a feeding section of said antenna electrically connected to said fixture at said mounting and having another end of the fixture connected to a mounting point on a vehicle body, and said fixture being defined such that a distance between said grounding point and said mounting point on said vehicle body is ½ wave length in electrical length.

* * * * *